US008627925B2

(12) United States Patent
Webster

(10) Patent No.: US 8,627,925 B2
(45) Date of Patent: Jan. 14, 2014

(54) FOLDABLE WORK PLATFORM

(75) Inventor: Thomas Webster, Angola, IN (US)

(73) Assignee: Vestil Manufacturing Corporation, Angola, IN (US)

( * ) Notice: Subject to any disclaimer, the term of this patent is extended or adjusted under 35 U.S.C. 154(b) by 654 days.

(21) Appl. No.: 11/383,243

(22) Filed: May 15, 2006

(65) Prior Publication Data

US 2007/0261917 A1 Nov. 15, 2007

(51) Int. Cl.
*E04G 5/14* (2006.01)
*E04G 3/28* (2006.01)

(52) U.S. Cl.
USPC ..... 182/113; 182/148

(58) Field of Classification Search
USPC ..... 182/113, 148
See application file for complete search history.

(56) References Cited

U.S. PATENT DOCUMENTS

| | | | | | |
|---|---|---|---|---|---|
| 2,099,908 | A | * | 11/1937 | Rosengarten | 473/193 |
| 3,016,973 | A | * | 1/1962 | Williamson | 182/14 |
| 3,016,989 | A | | 1/1962 | Lindmark | |
| 3,638,758 | A | | 2/1972 | Weisker | |
| 3,844,382 | A | * | 10/1974 | Mecklenburg | 187/222 |
| 4,150,762 | A | * | 4/1979 | Brunette | 220/485 |
| 4,185,716 | A | * | 1/1980 | Rinehart | 182/2.5 |
| 4,467,888 | A | * | 8/1984 | Hickling | 182/19 |
| 4,469,198 | A | | 9/1984 | Crump | |
| 4,754,840 | A | | 7/1988 | MacDonald et al. | |
| 4,979,588 | A | * | 12/1990 | Pike et al. | 182/18 |
| 5,129,480 | A | * | 7/1992 | Garrett et al. | 182/2.7 |
| 5,299,653 | A | | 4/1994 | Nebel | |
| 5,497,851 | A | | 3/1996 | Walcher et al. | |
| 5,503,430 | A | * | 4/1996 | Miki et al. | 280/756 |
| 5,586,616 | A | * | 12/1996 | Ksenych | 182/222 |
| 5,803,204 | A | * | 9/1998 | White et al. | 182/148 |
| 6,089,353 | A | * | 7/2000 | Bartels et al. | 187/224 |
| 6,145,619 | A | * | 11/2000 | Risser | 182/113 |
| 6,152,264 | A | | 11/2000 | Gaines, Sr. et al. | |
| D518,269 | S | * | 3/2006 | Henshaw et al. | D34/38 |
| 2007/0074935 | A1 | * | 4/2007 | Zahn | 182/141 |

OTHER PUBLICATIONS

Brochure entitled "Fork Truck Attachments". p. 97, published by Vestil Manufacturing Corporation, date unknown.

* cited by examiner

*Primary Examiner* — Alvin Chin Shue
(74) *Attorney, Agent, or Firm* — Faegre Baker Daniels LLP

(57) ABSTRACT

The present invention generally relates to work platforms, and, more particularly, to a work platform for use with a lift truck to elevate personnel safely and conveniently.

10 Claims, 5 Drawing Sheets

FOLDABLE WORK PLATFORM

TECHNICAL BACKGROUND

The present invention generally relates to work platforms, and, more particularly, to a work platform for use with a lift truck to elevate personnel safely and conveniently.

BACKGROUND OF THE INVENTION

Generally a work platform is a portable enclosure for elevating personnel to a desired location. Typically work platforms may be transported, elevated or lowered by the tines of a fork truck or lift truck. The safety of personnel enclosed in the work platform is of the utmost concern. Some safety features on work platforms may include kick-plates, high handrails, mid-rails and a vertically extending guard barrier adjacent to the lift truck to prevent a worker from becoming entangled in components of the lifting mechanism of the lift truck. Additional safety features may include safety chains or straps, pin-style tine locks, and fork pockets to secure the work platform to the lift truck.

Typically, fork pockets positioned on the bottom side of a work platform do not protect against the work platform sliding off of the tines of a lift truck. Safety chains or straps and pin-style tine locks may be connected to the lift truck to prevent the work platform from being inadvertently pushed off of the tines of the lift truck by an overhead structure when the work platform is elevated. Some state safety regulations may require separating a work platform from a lift truck when not in operation. Unimpeded inspection of a work platform may be easier if the work platform is separated from a lift truck. However, consistent separation and reattachment of a work platform from a lift truck may increase the risk of failing to reattach safety chains or straps and pin-style tine locks. Busy operators and personnel may not always remember to reattach safety chains or pin-style tine locks.

SUMMARY OF THE INVENTION

The present invention provides an adjustable guard barrier that is capable of releasably moving an adjustable barrier upon impact. The adjustable barrier may be pivotally raised or lowered.

One embodiment of the present invention is a work platform for use with a lift truck, the work platform including, a base, a guard rail supported by the base, and a guard barrier rigidly coupled to the base, the base, the guard rail and the guard barrier defining an enclosure, and an adjustable barrier operably coupled to the guard barrier, the adjustable barrier extending above the guard barrier and configured to pivot between a substantially vertical position and a substantially horizontal position.

Another embodiment of the present invention is a work platform for use with a lift truck, the work platform including, a base, at least one guard rail supported by the base, and a guard barrier, the base, the guard rail and the guard barrier defining an enclosure, an adjustable barrier operably coupled to the guard barrier, and means for movement of the adjustable barrier upon contacting an overhead structure.

A further embodiment of the present invention is a work platform for use with a lift truck, the work platform including, a base, a guard barrier rigidly coupled to the base, an adjustable guard barrier coupled to the guard barrier, a plurality of side fences rigidly coupled to the base, and an adjustable support coupled to the guard barrier and the adjustable barrier, the adjustable support configured to allow the adjustable barrier to pivot downward when the adjustable barrier contacts an overhead structure.

DETAILED DESCRIPTION

The embodiments described below are merely exemplary and are not intended to limit the invention to the precise forms disclosed. Instead, the embodiments were selected for description to enable one of ordinary skill in the art to practice the invention.

Figure 1:
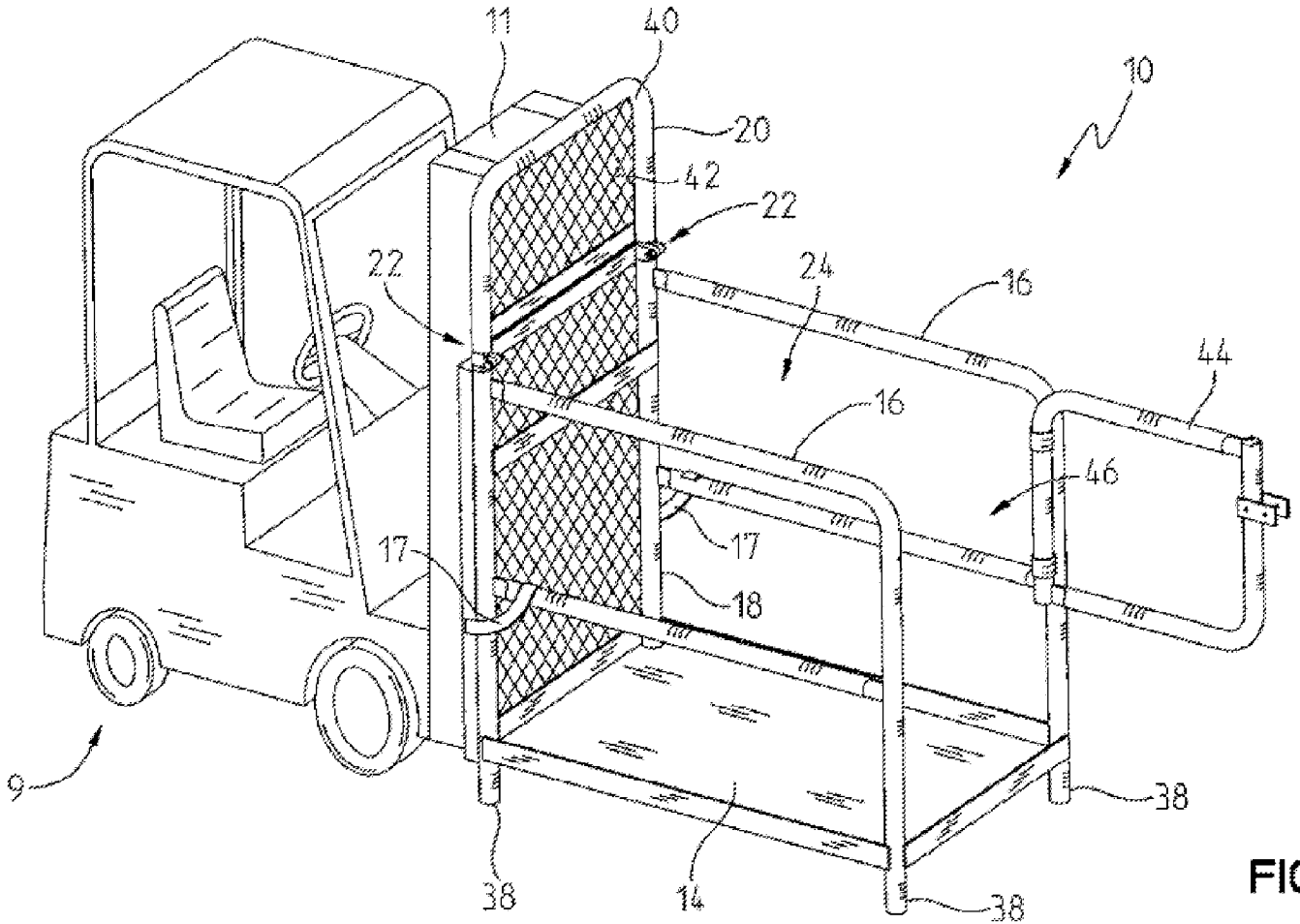
FIG. 1 is a perspective view of one embodiment of a work platform of the present invention in association with a lift truck.

Referring now to FIG. 1, a work platform 10 including base 14, guard rails 16, guard barrier 18, adjustable barrier 20, and door 44 is shown. The adjustable barrier includes a first structure 40 that extends around and surrounds a second structure 42. The second structure 42, in the illustrated embodiment, extends between the first structure 40. In the illustrated embodiment, the second structure 42 may include, but is not limited to, a screen that is coupled with the first structure 40. Work platform 10 is configured to be lifted by a lift truck or fork truck 9. Safety straps 17 may be used with pin style tin locks or any other suitable fasteners to secure work platform 10 to lifting mechanism 11 of lift truck 9. Base 14, guard rails 16, guard barrier 18, and door 44 cooperate to define enclosure 24. Guard barrier 18 is rigidly coupled to base 14. Adjustable barrier 20 is pivotally coupled to guard barrier 18 and extends upward to prevent a worker in enclosure 24 from becoming injured by moving parts of lifting mechanism 11 of lift truck 9. Door 44 is illustratively coupled to guard rails 16 at the ends opposite from guard barrier 18 and adjustable barrier 20. Door 44 illustratively pivots about one guard rail 16 from an open configuration (FIG. 1) that exposes access opening 46 into enclosure 24 between both guard rails 16 and a closed configuration (FIG. 2) that closes or blocks the access opening 46 into enclosure 24 between guard rails 16. As illustrated by FIG. 1, in this embodiment enclosure 24 is generally rectangularly shaped, however enclosure 24 may be of any suitable shape.

Figure 2:
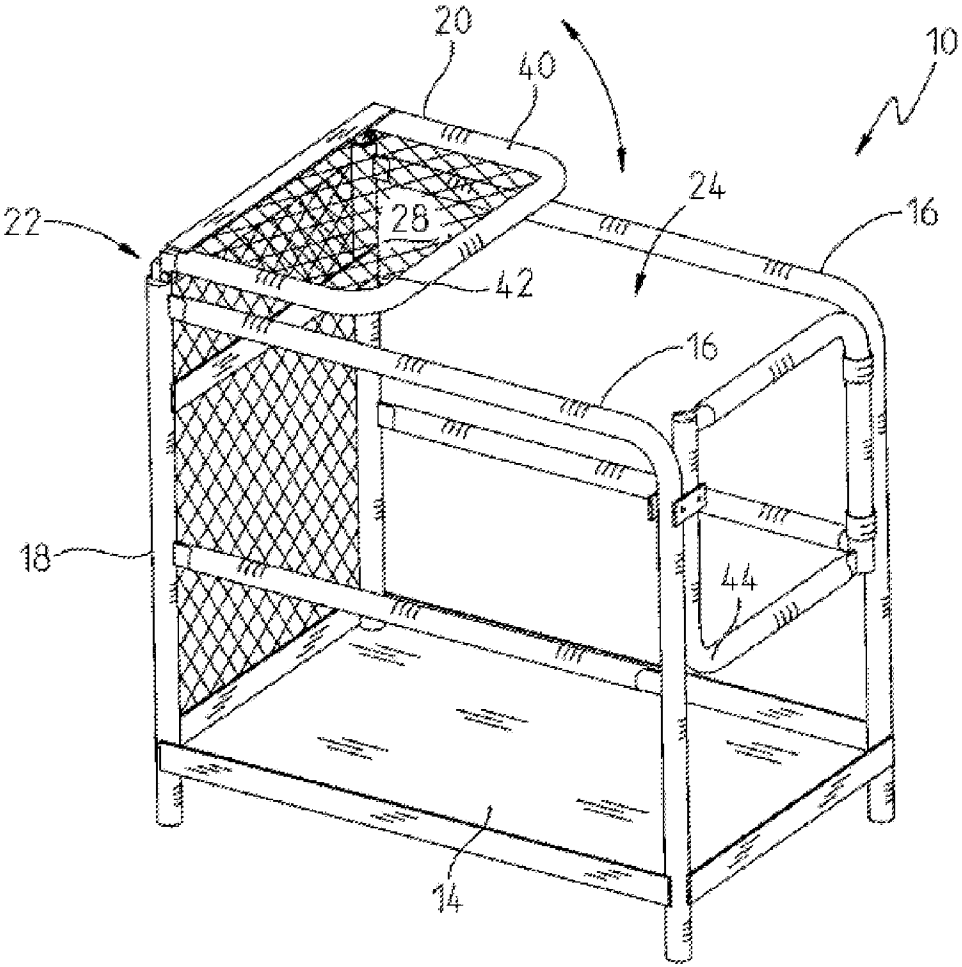
FIG. 2 is a perspective view of the work platform shown in of FIG. 1.

Work platform 10 also includes adjustable supports 22. Adjustable supports 22 couple guard barrier 18 to adjustable barrier 20. Adjustable supports 22 allow adjustable barrier 20 to pivot in relation to guard barrier 18. As illustrated in FIGS. 1 and 2, adjustable barrier 20 may pivotal relative to guard barrier 18 to a range of positions from a substantially vertical position, as shown in FIG. 1, to a substantially horizontal position, as shown in FIG. 2.

Figure 3:
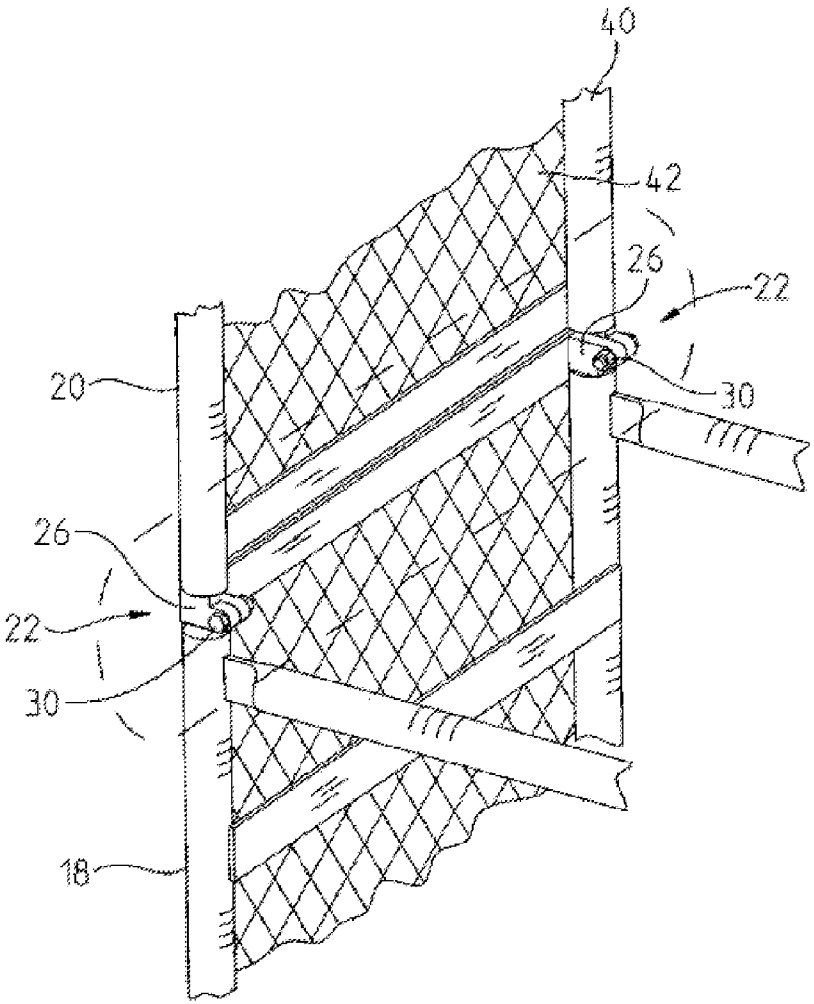
FIG. 3 is a partial, perspective view, of a portion of the adjustable barrier and guard barrier of the work platform shown in the previous figures.

Referring now to FIG. 3, a partial view of adjustable supports 22 is shown. Adjustable supports 22 include hinges 26 and hinge bolts 30. Hinges 26 couple to adjustable barrier 20 and guard barrier 18 to allow rotational movement relative to each other. In this embodiment, adjustable barrier 20 is held in the vertical position, as shown in FIG. 1, by tightening hinge bolts 30 to create a sufficient amount of friction in hinges 26 to hold adjustable barrier 20 in the vertical position. In the illustrated embodiment, adjustable supports 22 include friction fit hinges, however, in other embodiments (not shown), any suitable adjustable support such as a shear pin assembly may be used for adjustable supports 22.

Figure 4:
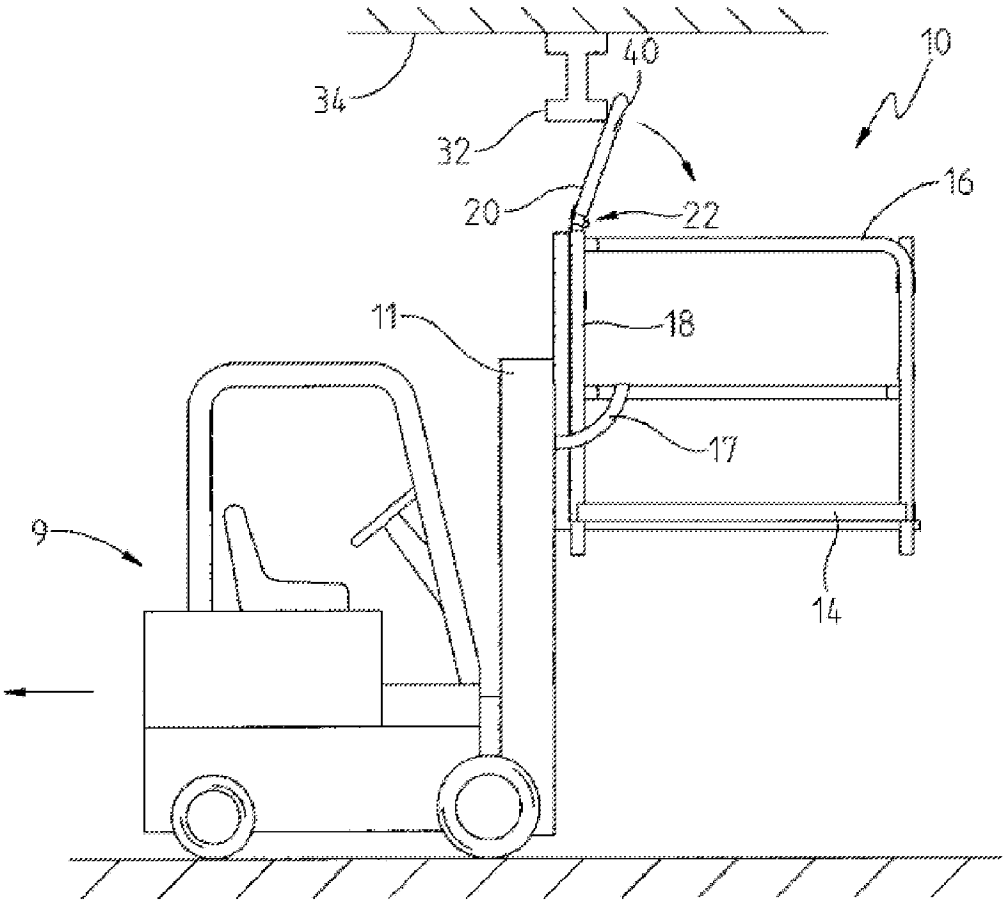
FIG. 4 is a profile view of the work platform and lift truck shown in FIG. 1 with the work platform shown in an elevated position in which the adjustable barrier of the work platform comes into contact with an overhead structure during rearward movement of the lift truck.
Figure 5:
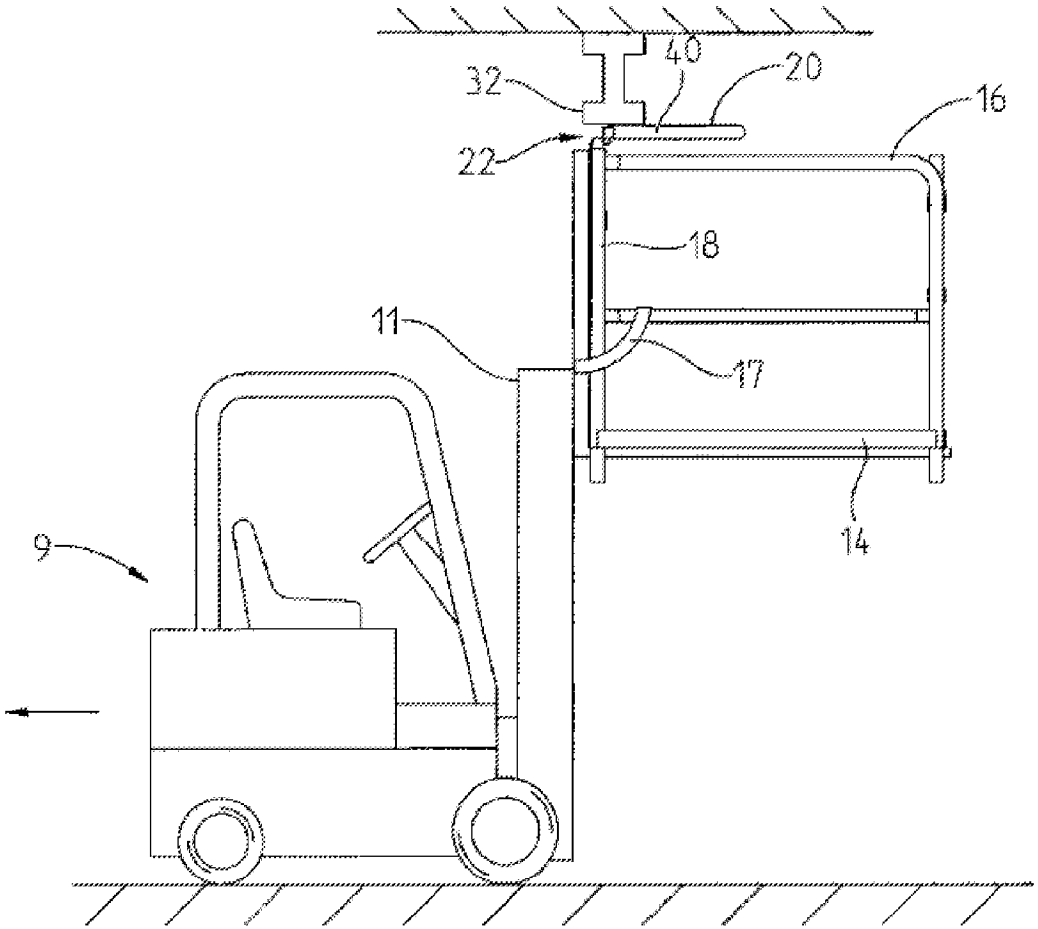
FIG. 5 is a profile view of the work platform and lift truck shown in FIG. 4 with the work platform shown in an elevated position in which the adjustable barrier is collapsed by contacting overhead structure during rearward movement of the lift truck.

Referring now to FIGS. 4 and 5, work platform 10 is shown in use. In FIG. 4, work platform 10 is shown positioned on the tines of lift truck 9 in an elevated position. In this embodiment, lift truck 9 is moving rearward. The first structure 40 of adjustable barrier 20 of work platform 10 is shown contacting I-beam 32 of overhead structure 34. Upon impact, adjustable barrier 20 pivots downward 30 in relation to guard barrier 18. In FIG. 5, as lift truck 9 continues to move rearward, adjustable barrier 20 is pivoted or folded down to allow work platform 10 to pass under I-beam 32. Pivotal movement of adjustable barrier 18 may prevent work platform 10 from being pushed off of the tines of lift truck 9 that are supporting work platform 10. Adjustable supports 22 may be adjusted so that sufficient force is provided to maintain adjustable barrier 20 in the vertical position until adjustable barrier 20 contacts an overhead structure. The force required to move adjustable barrier 20 from the vertical position is less than the force required to push work platform 10 off of the tines of lift truck 9.

Adjustable barrier 20 may perform multiple functions for work platform 10. If adjustable barrier 20 is in the substantially horizontal position, as shown in FIG. 2, a first side 28 of adjustable barrier 20 may serve as a shelf, as illustrated by FIG. 2. An operator on work platform 10 may position adjustable barrier 20 in the horizontal position to form shelf 28. When adjustable barrier 20 is in the horizontal position, a worker on work platform 10 should be positioned a sufficient distance from lifting mechanism 11 of lift truck 9 to prevent injury. Also when adjustable barrier 20 is in the substantially horizontal position, work platform 10 may require less storage space when compared to a work platform lacking an adjustable barrier of similar height.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

The invention claimed is:

1. A work platform for use with a lift truck, the work platform including:

a base, at least one guard rail supported by the base, and a guard barrier, the base, the guard rail and the guard barrier defining an enclosure;

an adjustable barrier operably coupled to the guard barrier, the adjustable barrier comprising a first structure surrounding a second structure;

means for movement of the adjustable barrier between a substantially vertical position and a substantially horizontal position upon contacting an overhead structure, wherein the adjustable barrier is moveable between a substantially vertical position and a substantially horizontal position and is operable as a shelf when the adjustable barrier is in the substantially horizontal position; and a door moveably coupled to the at least one guard rail, the door having a closed configuration that closes an access opening into the enclosure and an open configuration that exposes the access opening into the enclosure whether the adjustable barrier is in the substantially vertical position or the substantially horizontal position.

2. The work platform of claim 1, wherein, when the door is in the closed configuration, the at least one guard rail, the guard barrier, and the door cooperate to completely surround the base such that an operator standing on the base is completely surrounded by the at least one guard rail, the guard barrier, and the door whether the adjustable barrier is in the substantially vertical position or the substantially horizontal position.

3. The work platform of claim 1, wherein the door and the adjustable barrier are positioned at opposite ends of the base.

4. The work platform of claim 1, wherein, when the adjustable barrier is in the substantially horizontal position, the second structure of the adjustable barrier is positioned above the guard barrier.

5. The work platform of claim 1, further including one or more fasteners to releasably couple the work platform to the lift truck.

6. The work platform of claim 1, wherein the enclosure is substantially rectangularly shaped.

7. The work platform of claim 1, wherein a first force required for releasable movement of the adjustable barrier is less than a second force required to slide the work platform off of the lift truck.

8. The work platform of claim 1, wherein the means for movement includes a friction fit hinge coupled between the guard barrier and the adjustable barrier.

9. The work platform of claim 1, wherein the adjustable barrier extends above the guard barrier.

10. The work platform of claim 1, wherein the second structure of the adjustable barrier has a substantially planar surface that forms the shelf when the adjustable barrier is in the substantially horizontal position.

* * * * *